United States Patent [19]

Cornell

[11] Patent Number: 5,018,727

[45] Date of Patent: May 28, 1991

[54] THREE IN ONE EXERCISE BENCH

[76] Inventor: Daniel M. Cornell, 538 Turner Rd., Meadville, Pa. 16335

[21] Appl. No.: 528,372

[22] Filed: May 25, 1990

[51] Int. Cl.[5] ..... A63B 21/00

[52] U.S. Cl. ..... 272/144; 272/123

[58] Field of Search ..... 272/114, 117, 118, 144, 272/122, 123, 134

[56] References Cited

U.S. PATENT DOCUMENTS

| | | | |
|---|---|---|---|
| 4,353,547 | 10/1982 | Jenkinson | 272/130 |
| 4,641,837 | 2/1987 | Ruth | 272/123 |
| 4,653,751 | 3/1987 | Green | 272/144 |
| 4,667,955 | 5/1987 | Giesch | 272/130 |
| 4,700,944 | 10/1987 | Sterba et al. | 272/117 |
| 4,709,923 | 12/1987 | Gibson | 272/134 |
| 4,720,099 | 1/1988 | Garlson | 272/134 |
| 4,728,255 | 3/1988 | Kirkpatrick et al. | 415/119 |
| 4,741,529 | 5/1988 | Bloemendaal | 272/130 |
| 4,786,051 | 11/1988 | Mullican | 272/134 |
| 4,792,135 | 12/1988 | Chin-Sen | 272/134 |
| 4,793,608 | 12/1988 | Mahnke et al. | 272/123 |
| 4,801,139 | 1/1989 | Vanhoutte et al. | 272/130 |
| 4,817,943 | 4/1989 | Pipasik | 272/117 |
| 4,828,101 | 5/1989 | Fluck | 196/429 |
| 4,848,739 | 7/1989 | Schaub et al. | 272/134 |
| 4,861,024 | 8/1989 | Lee | 272/123 |

*Primary Examiner*—Robert Bahr
*Assistant Examiner*—Jerome W. Donnelly
*Attorney, Agent, or Firm*—Charles L. Lovercheck; Wayne L. Lovercheck; Dale Lovercheck

[57] ABSTRACT

An exercising device having a longitudinally extending frame, a first side and a second side. Spaced first legs, second legs and intermediate legs are fixed to the longitudinally extending frame and extend upwardly therefrom. A first seat frame and a second seat frame are swingably supported on the first side and the second side of the frame. The first seat frame is swingable to a first position with the distal end thereof resting on a support surface or swingable to a second position with the distal end thereof resting on a lateral intermediate member and forming a continuation of a fixed seat frame. The second seat frame is swingably attached to the longitudinally extending frame at an intermediate position between the second legs and the intermediate legs. The second seat frame can be removed or swung to a second position parallel to a support surface or can be swung to a third position with the distal end thereof resting on a transversely cross member of a U-shaped member supported on the fixed seat frame, thereby providing a three-in-one exercise bench.

9 Claims, 2 Drawing Sheets

THREE IN ONE EXERCISE BENCH

BACKGROUND OF THE INVENTION

This invention relates to exercising equipment and more particularly to the type of exercising equipment known as weight lifting benches.

Applicant is aware of the following prior art patents, none of which disclose applicant's invention.

| | |
|---|---|
| 4,653,751 to Green | 4,786,051 to Mallican |
| 4,641,837 to Ruth | 4,792,135 to Chin-Sen |
| 4,667,955 to Giesch | 4,793,608 to Mahnke et al |
| 4,700,944 to Sterba et al | 4,801,139 to Vanhoutte et al |
| 4,709,923 to Gibson | 4,817,943 to Pipasik |
| 4,720,099 to Carlson | 4,828,101 to Fluck |
| 4,728,255 to Kirkpatrick et al | 4,848,739 to Schaub et al |
| 4,741,529 to Bloemendaal | 4,861,024 to Lee |

SUMMARY OF THE INVENTION

There is a real need for an exercising bench such as applicant's. The normal home owner and college student is limited in the space they have. Moreover, gyms and spas are over crowded and space is a critical item. The bench of the present application has some unique features not found in other benches. To use the bench shown herein, the lifter positions himself or herself on the inclining part of the bench allowing the lifter to assert more power on the up lift and more control on the down lift, thereby allowing the lifter to increase his or her chest size.

The present bench can be changed to carry out any one of the three basic weight lifting routines which are: incline bench, FIG. 4; decline bench, FIG. 3; regular bench, FIG. 5. The bench saves space and time. It saves space in that it takes up the space of one bench and not the typical three benches. It saves time in that when a group of lifters are to do chest exercises, they can do all three routines at one bench instead of tying up three separate benches. Thus, if an establishment has (for example) three benches, there can be three different groups of lifters doing chest exercises on this type of bench, where only one group of lifters would tie up three benches to be chest exercises.

The lifter does not need someone to hand the dumbbells to him or her when in the inclined position because the lifter can reach the dumbbells while in the lifting position without straining or over stretching. (See FIG. 5).

This bench is designed so that the spotter is located in the most beneficial spot to provide the maximum protection and guidance to the lifter. Leg adjusters are provided to level the bench. The seat hinges are designed for quick bench changes. This bench may have a height of 30 inches when it is in the inclined position without the seat. The bench of the present application will pass through the usual door way. The bench may be set up as a sit-up bench. The bench is adapted to set up as a preacher bench, a back extender and leg and hamstring extender.

This bench comprises a three-in-one bench (incline, decline and regular bench) all in one of spa quality, or for personal use. It quickly transforms into any one of three types of benches, allowing a group to do all three chest workouts at one station. It uses the space of one bench so it saves space and time allowing lifters to have a group at the same bench throughout their chest routine that involves a bench. The more of these benches an establishment has, the more groups one can have working at the same time. For example: three benches; three groups. It has an added feature to the incline part of the bench that allows a lifter to lift more weight than with a regular incline bench, thus allowing a lifter to possibly increase the size of his chest.

The present invention has a frame with a fixed seat and two spaced seat members swingably attached to the frame in a manner that allows each of the seats to be swung alternatively to either of two positions so that the bench functions as three different benches. Each of the swingable members spring to either of two positions providing body rests for three positions of the body of the user.

It is an object of the invention to provide an improved exercising bench.

Another object of the invention is to provide a three position exercising bench.

Another object of the invention is to provide an exercising bench that is simple in construction, economical to manufacture and simple and efficient to use.

With the above and other objects in view, the present invention consists of the combination and arrangement of parts hereinafter more fully described, illustrated in the accompanying drawing and more particularly pointed out in the appended claims, it being understood that changes may be made in the form, size, proportions and minor details of construction without departing from the spirit or sacrificing any of the advantaged of the invention.

DESCRIPTION OF THE PREFERRED EMBODIMENT

Figure 1:
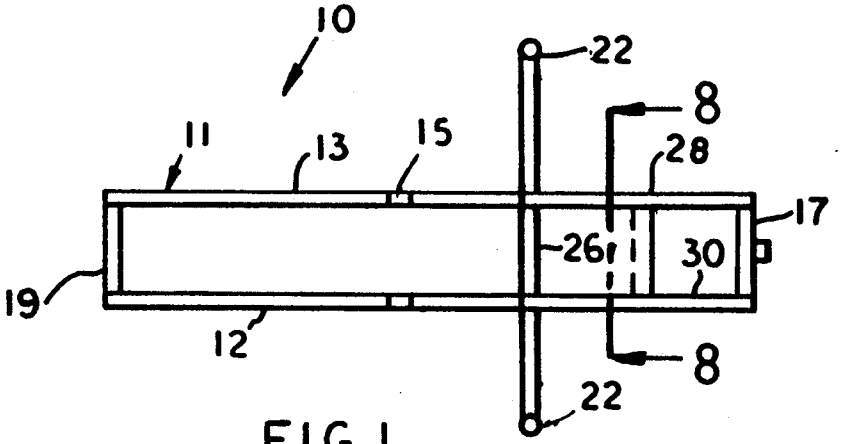
FIG. 1 is a top view of the exercise bench according to the invention.

Now with more particular reference to the drawing, exercise bench 10 has frame 11 made up of longitudinally extending first side 12 and second side 13. First side 12 and second side 13 have one of their ends fixed to laterally spaced end support members or first legs 18 and to laterally spaced support members or intermediate legs 22. First fixed member 17 holds second legs 20 in spaced relation to one another. First legs 18 are attached to first side 12 and second side 13 respectively with laterally extending second fixed member 19, which hold first legs 18 and second legs 20 in spaced generally parallel ralation.

End parts 21 telescopically slide over first side 12 and second side 13. End parts 21 are fixed to second legs 20.

Thus second legs 20 can be adjusted toward and away from intermediate legs 22. First legs 18, second legs 20 and intermediate legs 22 each have adjustable floor engaging means or leg adjusters 34 fixed thereto. Intermediate legs 22 are fixed to intermediate lateral member 26. Intermediate lateral member 26 is fixed to first side 12 and second side 13. Intermediate lateral support member 26 is fixed to lower spaced longitudinal support member 30.

Intermediate legs 22 each have an adjustable telescopic extension 25 which has a weight lifter's weight support means 27 thereon. Telescopic extension 25 is telescopically received in intermediate legs 22 for supporting the connecting bars of weight lifter's weights.

Figure 7:
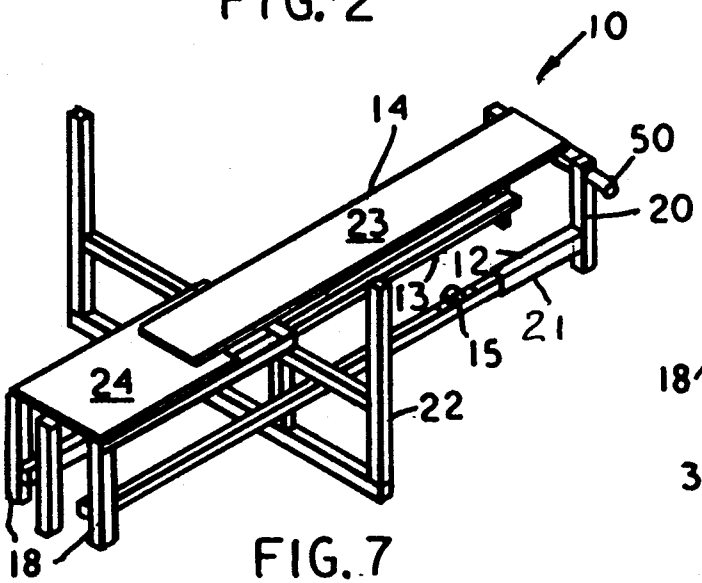
FIG. 7 is an isometric view of the bench according to the invention.

Inclined first seat frame 14 may be swingably attached to the upper ends of second legs 20 so that first seat frame 14 inclines toward intermediate lateral member 26 and downwardly. First seat frame 14 can be swung to the position shown in FIG. 4 and can also be swung to a position to rest on U-shaped member 32 to form a regular bench as shown in FIG. 7.

Figure 4:
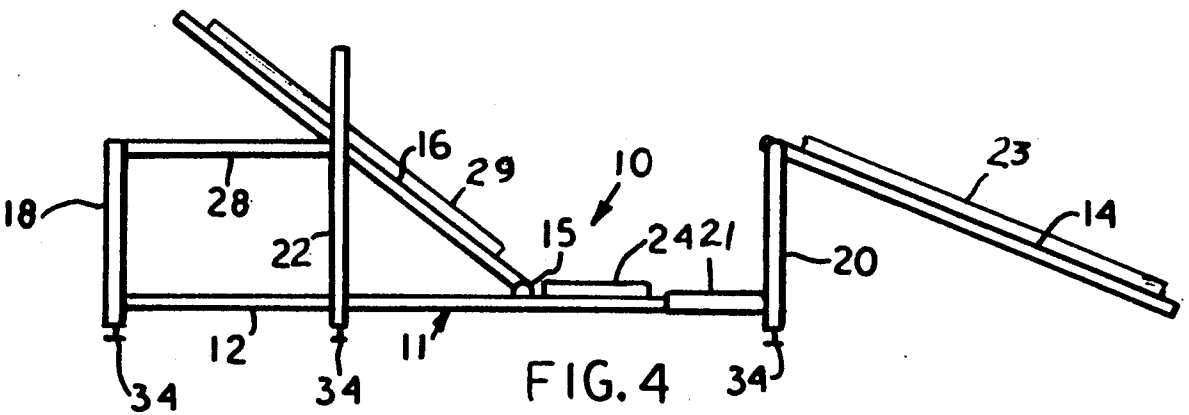
FIG. 4 is a side view of the bench with one frame seat inclined upward and the other downward.
Figure 6:
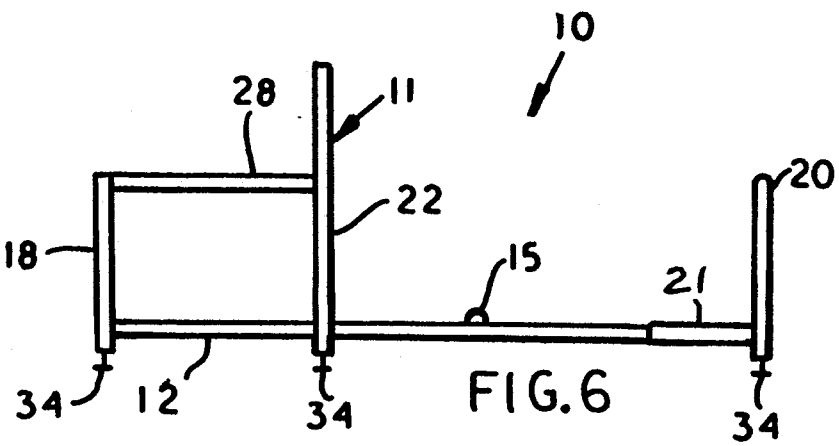
FIG. 6 is another side view of the bench with two seat frames removed.
Figure 5:
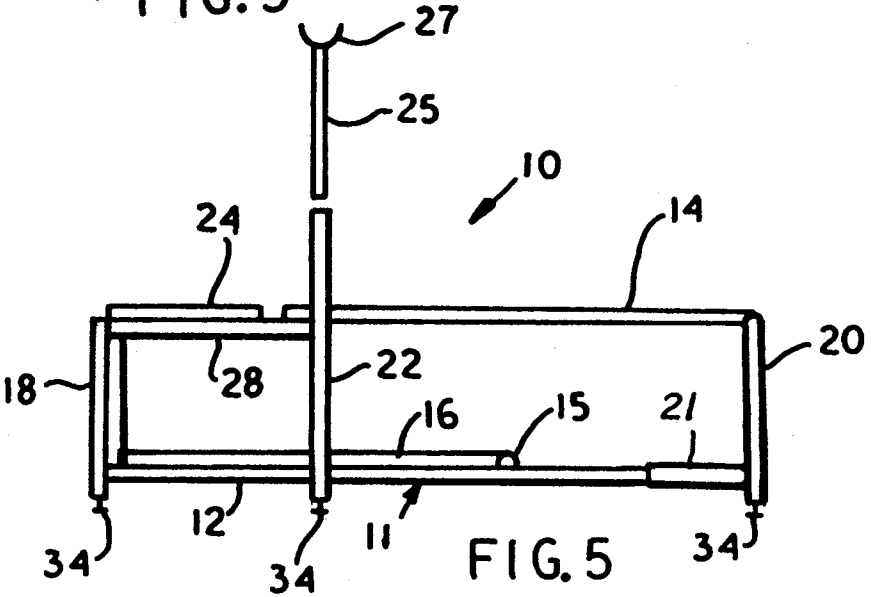
FIG. 5 is a side view of the bench according to the invention.
Figure 8:
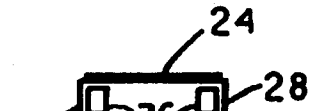
FIG. 8 is a cross sectional view taken on line 8—8 of FIG. 1.
Figure 9:
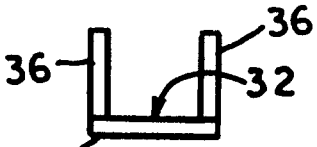
FIG. 9 is a top view of the U-shaped part of the bench.

Second seat frame 16 is swingably attached to first side 12 and second side 13 at first pivot 15 and can be swung from the position shown in FIG. 4 to the position shown in FIG. 5, or second seat frame 16 can be quickly removed by pulling pins, such as pin 50, from second pivot 51.

First seat frame 14 has first body support member 23 and second seat frame 16 has second body support member 29 extending thereon to support a person using exercise bench 10. Third body support member 24 is fixed to fixed seat frame 28.

Fixed seat frame 28 is in the form of U-shaped channels which open toward the center of frame 11. Legs 36 of U-shaped member 32 are slidably received in channels of fixed seat frame 28 so that cross member 40 provides a support for second seat frame 16 when in the position shown in FIG. 4. Legs 36 of U-shaped member 32 are held together by transversely extending cross member 40 which forms a support for first seat frame 14 when it is swung to the position shown in FIG. 5, or first seat frame 14 can be pivoted to a second position resting on a support surface as shown in FIG. 4. First seat frame 14 can also be swung down to rest on intermediate lateral member 26, to the position shwon in FIG. 3 when the bench is arranged to be used to carry out a lifting exercise using first seat frame 14 in that position.

First seat frame 14 may be made of two laterally spaced members with first body support member 23 supported thereon. Second seat frame 16 will also be made of two laterally spaced members with second body support member 29 supported thereon. Fixed seat frame 28 will have third body support member 24 supported thereon. First body support member 23, second body support member 29 and third body support member 24 may each be made of a padded plate, a canvas sheet or any suitable body support.

Figure 3:
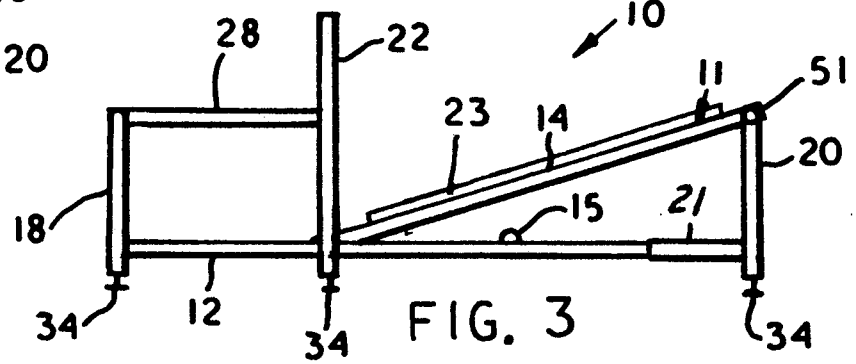
FIG. 3 is a side view of the bench with one seat frame removed and a second seat frame extending toward a fixed seat.
Figure 2:
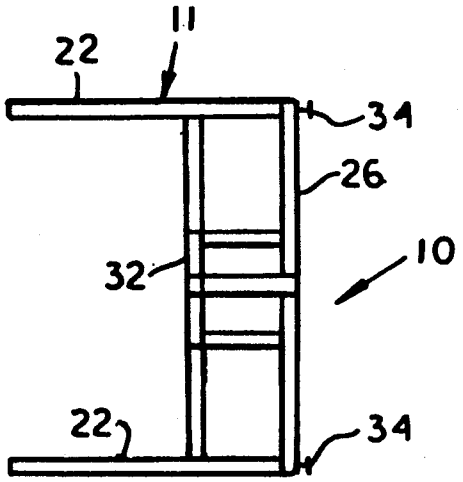
FIG. 2 is an end view of the bench shown in FIG. 1.

Bench 10 can be used with first seat frame 14 and second seat frame swung to the positions shown in FIGS. 3, 4 or 5. Hinge joints are provided at first pivot 15 between first seat frame 14, second seat frame 16 and fixed seat frame 28 by pins 50 which extend through first pivots 15 and second pivots 51. Pins 50 can be readily removed from the pivots to quickly remove first seat frame 14 and second seat frame 16.

The foregoing specification sets forth the invention in its preferred, practical forms but the structure shown is capable of modification within a range of equivalents without departing from the invention which is to be understood is broadly noval as is commensurate with the appended claims.

The embodiments of the invention in which an exclusive property or privilege is claimed are defined as follows:

1. An exercise bench comprising a longitudinal frame, a first side, a second side, first legs, second legs and intermediate legs, said first legs, said second legs and said intermediate legs being attached to said first side and to said second side and extending upwardly therefrom, a first seat frame swingably attached to said second legs at a position spaced from said intermediate legs and swingable from a position extending downwardly and away from said intermediate legs to a position extending downwardly and toward said intermediate legs, a second seat frame swingably attached to said first side and to said second side between said second legs and said intermediate legs and swingable from a position extending horizontally and toward said first legs to a position upward and toward said intermediate legs, a fixed seat frame attached to said first legs and to said intermediate legs.

2. The exercise bench recited in claim 1 wherein a lateral intermediate member is attached to said first side and to said second side, said intermediate legs are attached to said lateral intermediate member and extend upwardly therefrom.

3. The exercise bench recited in claim 2 wherein a third body support member is supported on said fixed seat frame.

4. The exercise bench recited in claim 3 wherein said fixed seat frame comprises two U-shaped channels.

5. The exercise bench recited in claim 4 wherein said fixed seat frame receives a U-shaped member, said U-shaped member having legs and a transversely extending cross member, said U-shaped channels of said fixed seat frame receiving said legs of said U-shaped member, said cross member of said U-shaped member comprises a support for an end of said first seat frame when swung toward said intermediate legs.

6. The exercise bench recited in claim 5 wherein a telescopic extension is adapted to be telescopically received in said intermediate legs, a weight support means is disposed on said telescopic extension.

7. The exercise bench recited in claim 6 wherein an adjustable floor engaging means is attached to each of said first legs, said second legs and said intermediate legs at the lower ends thereof for adjusting the level of said exercise bench relative to a floor, a support surface or the like.

8. The exercise bench recited in claim 7 wherein said first seat frame, said second seat frame and said fixed seat frame each have a body support member attached thereto.

9. The exercise bench recited in claim 7 wherein said first side and said second side terminate at a position spaced from said second legs and are attached to said second legs by means of end parts, said end parts slidably and telescopically receive said first side and said second side whereby said second legs can be adjusted toward and away from said intermediate legs.

* * * * *